US006470857B2

(12) United States Patent
Takahashi et al.

(10) Patent No.: US 6,470,857 B2
(45) Date of Patent: Oct. 29, 2002

(54) FLOW AMOUNT CONTROL DEVICE

(75) Inventors: Tohru Takahashi, Nishikasugai-gun (JP); Hiroyuki Nishimura, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/876,043

(22) Filed: Jun. 8, 2001

(65) Prior Publication Data

US 2002/0000217 A1 Jan. 3, 2002

(30) Foreign Application Priority Data

Jun. 26, 2000 (JP) ..... 2000-190624

(51) Int. Cl.[7] ..... F02M 59/20; F02M 59/34

(52) U.S. Cl. ..... 123/462; 123/467; 123/458; 123/506; 123/510; 417/505

(58) Field of Search ..... 123/467, 462, 123/497, 498, 458, 499, 510, 502, 506; 239/601, 533.12; 417/441, 505; 251/129.15

(56) References Cited

U.S. PATENT DOCUMENTS 6,016,790 A * 1/2000 Makino et al. ..... 123/458
6,089,470 A * 7/2000 Teerman et al. ..... 239/88
6,311,674 B1 * 11/2001 Igashira et al. ..... 123/458
6,390,072 B1 * 5/2002 Breeden ..... 123/495
2001/0032618 A1 * 10/2001 Ramseyer et al. ..... 123/446
2001/0048091 A1 * 12/2001 Enomoto et al. ..... 251/129.15

FOREIGN PATENT DOCUMENTS

JP 113602 * 7/1983 ..... F15B/11/00
JP 229999 * 8/1999 ..... F02M/55/00
JP 11-257191 9/1999
JP 2002-4977 * 1/2002 ..... F02M/59/34
WO WO-02/14684 * 2/2002 ..... F02M/63/02

* cited by examiner

*Primary Examiner*—Tony M. Argenbright
*Assistant Examiner*—Hai H Huynh
(74) *Attorney, Agent, or Firm*—Nixon & Vanderhye P.C.

(57) ABSTRACT

In a flow amount control device which control flow amount of fuel to be supplied to a high pressure fuel pump, an opening, which communicates with a port for passing fuel to the high pressure fuel pump, is composed of a first rectangular opening, a second rectangular opening whose circumferential length is larger than that of the first opening, and a third trapezoidal opening bridging between the first and second openings. The port communicates with the first opening, when engine speed is low, and, as the engine speed increases, with the third and second openings. Accordingly, the flow amount of fuel to be discharged from the high pressure fuel pump varies non-linearly and a change of the flow amount thereof is small in engine low speed region.

12 Claims, 3 Drawing Sheets

FLOW AMOUNT CONTROL DEVICE

CROSS REFERENCE TO RELATED APPLICATION

This application is based upon and claims the benefit of priority of Japanese Patent Application No. 2000-190624 filed on Jun. 26, 2000, the content of which is incorporated herein by reference.

BACKGROUND OF THE INVENTION

1. Field of the Invention

The present invention relates to a flow amount control device, in particular, applicable to a flow amount control device that controls fuel amount to be supplied to a high pressure fuel pump in a common rail fuel injection system for a diesel engine (the diesel engine is hereinafter called an engine).

2. Description of Related Art

A common rail fuel injection system is well known as a system for injecting fuel to an engine. The common rail fuel injection system is provided with an accumulation chamber (common rail) commonly communicating with respective cylinders of the engine. A necessary amount of high pressure fuel is supplied to the common rail from the high pressure fuel pump whose fuel discharge amount is variable so that pressure of fuel accumulated in the common rail is kept constant. The high pressure fuel accumulated in the common rail is injected at a given timing to each engine cylinder from each injector that is connected to the common rail.

To keep pressure of fuel accumulated in the common rail constant, it is necessary to control flow amount of fuel to be supplied to the high pressure fuel pump and also to control flow amount of fuel to be discharged from the high pressure fuel pump according to engine operating conditions such as engine revolution or load.

The conventional common rail fuel injection system is provided with a fuel flow amount control device positioned between the high pressure fuel pump and a supply pump for delivering fuel to the high pressure fuel pump. The fuel flow amount control device serves to control flow amount of fuel to be supplied to the high pressure fuel pump and, thus, to control flow amount of fuel to be discharged from the high pressure fuel pump.

The conventional flow amount control device has an electromagnetic driving portion that drives a valve member according to a value of current applied thereto. A moving amount of the valve member varies in response to the value of current applied to the electromagnetic driving portion. Further, an area of opening formed in a valve body, through fuel passes to the high pressure fuel pump, varies according to the moving amount of the valve member slidably housed in the valve body. By controlling the flow amount of fuel that passes through the opening in the manner mentioned above, the flow amount of fuel to be supplied to the high pressure fuel pump is controlled.

However, since the opening of the valve body is formed in rectangular shape, the area of the opening through which fuel passes changes linearly in responsive to the value of current applied to the electromagnetic driving portion or the moving amount of the valve member. As a result, the flow amount of fuel to be supplied to the high pressure fuel pump and the flow amount of fuel to be discharged from the high pressure fuel pump vary linearly according to a value of engine load or engine revolution.

In a case that the opening area changes linearly in response to the moving amount of the valve member, a slight change of the moving amount of the valve member or a slight change of the opening area causes to change more largely the flow amount of fuel to be discharged from the high pressure fuel pump in an engine low speed region, compared with that in an engine high speed region since a time period during which the high pressure fuel pump sucks fuel is longer in the former region than in the latter region. Further, even if the engine revolution slightly changes in the engine low speed region, the time period during which the high pressure fuel pump sucks fuel and the amount of fuel to be sucked largely changes.

Accordingly, in the engine low speed region, the movement of the valve member affects largely on a change of the flow amount of fuel to be discharged from the high pressure fuel pump, causing to excessively increase or decrease fuel pressure in the common rail. As mentioned above, controllability of the flow amount of fuel to be discharged from the high pressure fuel pump is poor in the engine low speed region.

SUMMARY OF THE INVENTION

An object of the invention is to provide a flow amount control device in which a flow amount of fuel to be supplied to a high pressure fuel pump is adequately adjusted according to a value of engine revolution or engine load so that controllability of fuel amount of fuel to be discharged from the high pressure fuel pump is improved.

To achieve the above objects, in a flow amount control device for controlling flow amount of fuel to be supplied via a supply conduit to a high pressure fuel pump that discharges pressurized fuel to an accumulation chamber, a valve body has at least an opening for communicating with the supply conduit. The opening is composed of a first opening, a second opening whose circumferential length in the valve body is larger than that of the first opening, and a third opening bridging between the first and second openings in such a manner that the first, third and second openings are continuously formed in an axial direction of the valve body. A valve member, which is housed slidably inside the valve body, is provided inside with a fuel conduit through which fuel flows and in circumference with at least an outlet port connected to the fuel conduit. Driving means causes an axial movement of the valve member in the valve body when current is applied thereto.

With the flow amount control device mentioned above, an area of the opening communicating with the outlet port, through which fuel flows from the fuel conduit to the supply conduit, varies non-linearly in response to a moving amount of the valve member. That is, a change ratio of the area of the opening communicating with the outlet port to the moving amount of the valve member is variable and non-linear.

Accordingly, the change ratio of the area of the opening communicating with the outlet port to the moving amount of the valve member is smaller, when largeness of the area of the opening communicating with the outlet port is below a predetermined value, than that when the largeness of the area of the opening communicating with the outlet port is over the predetermined value. That is, a change ratio of the flow amount of fuel to be supplied to the high pressure fuel pump to the moving amount of the valve member is small in an engine low speed region and large in an engine high speed region.

As a result, controllability of the flow amount of fuel to be supplied to the high pressure fuel pump and controllability of the flow amount of fuel to be discharged from the high pressure fuel pump are improved in the engine low speed region. Further, the flow amount of fuel to be discharged from the high pressure fuel pump is sufficiently secured in the engine high speed region.

Preferably, the moving amount of the valve member changes in proportion to a value of the current to be applied to the driving means. In this case, the value of current to be applied to the driving means is controlled in response to engine revolution or engine load. The change ratio of the area of the opening communicating with the outlet port to the value of current applied to the driving means is smaller, when largeness of the area of the opening communicating with the outlet port is below a predetermined value, than that when the largeness of the area of the opening communicating with the outlet port is over the predetermined value.

Preferably, each shape of the first and second openings is roughly rectangular and shape of the third opening is trapezoidal. In this case, the flow amount of fuel to be supplied to the high pressure fuel pump varies in proportion to a change of the moving amount of the valve member in the engine low and high speed regions and varies smoothly along a quadratic functional line with respect to the change of the moving amount of the valve member in a transient region between the engine low and high speed regions.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

First Embodiment

Figure 1:
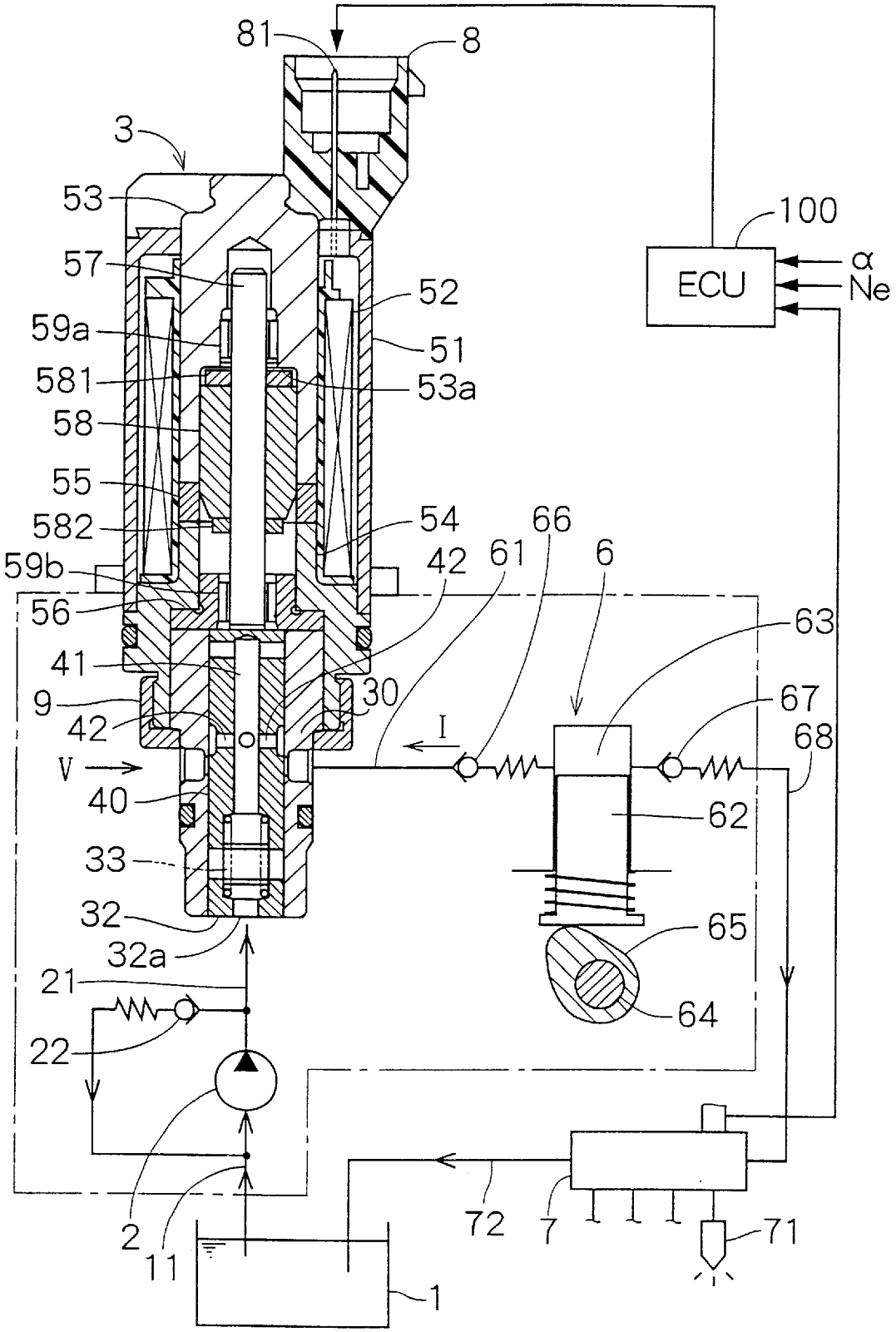
FIG. 1 is a schematic view of a common rail fuel injection system to which a flow amount control device according to a first embodiment of the present invention is applied.

FIG. 1 shows a common rail fuel injection system to which a flow amount control device according to a first embodiment of the present invention is applied.

The common rail fuel injection system is composed of a fuel tank 1, a supply pump 2, a flow amount control device 3, a high pressure fuel pump 6 and a common rail 7 as a pressure accumulation chamber. The supply pump 2, the flow amount control device and the high pressure fuel pump, which are surrounded by a dot-slash line in FIG. 1, are integrated as one body to constitute a fuel injection pump apparatus.

The fuel tank 1 stores fuel under normal pressure. The supply pump 2 delivers fuel stored in the fuel tank 1 to the flow amount control device 3 via fuel conduits 11 and 12. A return valve 22 is provided downstream of the supply pump and serves to return fuel to the fuel tank 1 when pressure of fuel delivered by the supply pump 2 exceeds a predetermined value.

Figure 2:
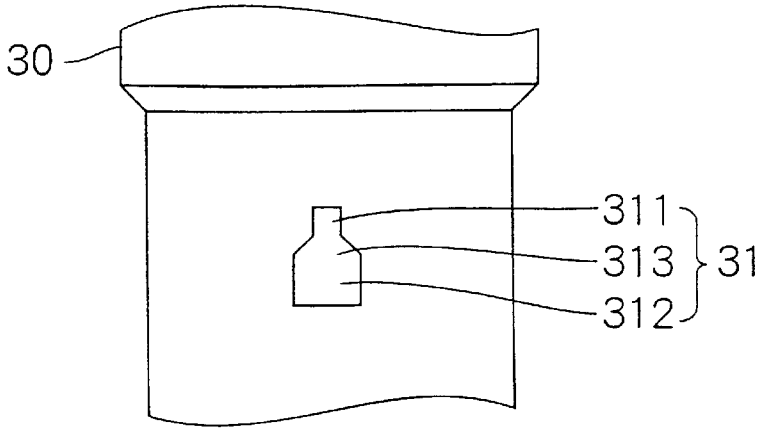
FIG. 2 is a side view of a portion near an opening of a valve body of the flow amount control device according to the first embodiment as viewed from a direction shown by an arrow I of FIG. 1.

The flow amount control device 3 is composed of a valve body 30, a valve member and an electromagnetic driving portion 50. The valve member 40 is slidably housed inside the valve body 30, which is formed in roughly cylindrical shape. As shown in FIG. 2, the valve body 30 is provided circumferentially with a plurality of openings 31. The openings 31, as shown in FIG. 2, are connected to a fuel supply conduit 61 through which fuel is supplied to the high pressure fuel pump 6. A bush 32 is fluid-tightly press fitted to a leading end of the valve body 30 on a side of the supply pump 2. A through-hole 32*a*, which is formed in a center of the bush 32, is connected to the fuel conduit 21. The through-hole 32*a* serves as a fuel inlet through which fuel flows into the flow amount control device 3.

The valve member 40, which is formed in roughly cylindrical shape, is housed to move axially and slidably in the valve body 30. The valve member is provided inside with a fuel conduit 41 to which a plurality of ports 42 are connected. Each end of the ports 42 on a side of the valve body 30 constitutes a fuel outlet through which fuel flows out of the flow amount control device 3. The communication between each of the ports 42 of the fuel conduit 41 and each of the openings 31 of the valve body is interrupted or opened by making the valve member move upward or downward in FIG. 1.

A spring 33 contacts an end of the valve member 40 on a side of the bush 32. An end of the spring 33 on a side opposite to the valve member 40 contacts the bush 32. The spring 33 urges the valve member 40 toward the electromagnetic driving portion 50.

The electromagnetic driving portion 50 is composed of a solenoid and a movable member. A yoke 51, a coil 52, a stator 53, a stator 54, a guide 55 and a stator cover 56 constitute the solenoid. The yoke 51 is formed in cylindrical shape and made of magnetic material. The coil 52, which is arranged along an inner circumference of the yoke 51, is connected with an electric terminal 81 of a connector 8. The stators 53 and 54, which are made of magnetic material, are connected, for example, by welding, with the guide 55 that is made of non-magnetic material. The stators 53 and 54 and the guide 55 are integrated with the coil 52 by being fitted or bonded by welding to an inner circumference of the coil 52. The stator cover 56 is fixed to the stator 54 by being press fitted to an inside of the stator 54.

The valve body 30 is inserted into an inner circumference of the stator 54 and fixed to the stator 54 by a retainer 9.

The moving member has a shaft 57 and an armature 58. The shaft 57 is press fitted into an inner circumference of the armature 58. The moving member is arranged slidably in inner circumferences of the stators and guide 53, 54 and 55 and supported by linear bearings 59*a* and 59*b*.

The armature 58 is made of magnetic material so that magnetic lines of force generated by the coil 52 pass through the stator 53, the armature 58, the stator 54 and the yoke 51, which form a magnetic circuit. Accordingly, the shaft 57 and the armature 58 are attracted toward the stator 54. An end of the armature 58 on a side of the stator cover 56 is formed in taper shape so that an axial length of a gap between the armature 58 and the stator 54 varies according to strength of magnetic force acting between the armature 58 and the stator 54. Therefore, a moving distance of the armature 58 (shaft 57) varies in response to a value of current applied to the coil 52. Axial opposite ends of the armature 58 are sandwiched by washers 581 and 582.

An end of the shaft 57 on a side of the stator cover 56 is in contact with an end of the valve member 40 on a side opposite to the bush 32 so that the valve member 40 moves according to movements of the armature and shaft 58 and 57.

In the high pressure fuel pump 6, a plunger 62 makes a reciprocating movement so that fuel inside a pressure chamber 63 is pressurized. Flow amount of fuel to be discharged from the high pressure fuel pump 6 varies according to flow amount of fuel to be flown into the pressure chamber 63. The plunger 62 is reciprocatingly driven upward and downward in FIG. 1 by a cam 65 installed on a crankshaft 64 of an engine (not shown) according to rotation of the crankshaft 64. Return valves 66 and 67 are attached to the high pressure fuel pump 6 so that, when the plunger 62 moves downward, fuel is sucked through the flow amount control device 3 and the fuel supply conduit 61 and, when the plunger 62 moves upward, fuel is pressurized and discharged to the common rail 7. A fuel delivery conduit 68 is connected to a discharge side of the high pressure fuel pump 6 and an end of the fuel delivery conduit 68 on a side opposite to the high pressure fuel pump 6 is connected to the common rail 7.

The common rail 7 connected to the fuel delivery conduit 68 accumulates fuel pressurized by the high pressure pump 6. Injectors 71, whose numbers are corresponding to the numbers of cylinders and inject fuel into the respective cylinders of the engine, are connected to the common rail 7. Fuel accumulated in the common rail 7 is injected from each of the injectors 71. A return conduit 72 is connected to the common rail 7 and excess fuel of the common rail 7 is returned to the fuel tank 1 via the return conduit 72.

The common rail fuel injection system has ECU 100. ECU 100 controls an output value of current to be applied to the coil 52 of the flow amount control device 3 based on parameters such as pressure of fuel inputted into the common rail 7, engine revolution Ne and accelerator opening degree a so that flow amount of fuel to be discharged from the high pressure fuel pump 6 is optimally controlled. Further, ECU 100 controls each valve opening and closing timing of electromagnetic valves (not shown) of the injectors 71 so that fuel injection timing and fuel amount in each cylinder of the engine are controlled.

Next, the opening 31 formed in the valve body 30 is described in more detail.

A first opening 311, a second opening 312 and a third opening 313 constitute the opening 31 formed in the valve body 30. The first, second and third openings 311, 312, and 313 are axially and continuously formed in order from a side of the electromagnetic driving portion 50.

The first and second openings 311 and 312 are formed in roughly rectangular, respectively, and an area of the first opening 311 is different from that of the second opening 312. Further, a width length of the first opening 311, that is, a length of the first opening 311 in a direction perpendicular to an axis of the valve body 30, is smaller that a width length of the second opening 312. Accordingly, an area change ratio of the opening 31 in an axial direction of the valve body on a side of the first opening is larger than that on a side of the second opening 312.

The third opening 313, which connects mutually the first and second openings 311 and 312, is formed between the first and second openings 311 and 312. The third opening is formed roughly in shape of a trapezoid that bridges the first and second openings 311 and 312. Accordingly, the opening 31 is shaped as shown in FIG. 2.

Fuel flow in the common rail fuel injection system is described hereinafter.

As shown in FIG. 1, the supply pump 2 supplies fuel from the fuel tank 1 to the flow amount control device 3. Fuel supplied by the supply pump 2 is flown into the flow amount control device 3 through the through-hole 32*a* of the bush 32 that is the fuel inlet. The fuel is further supplied to the respective ports 42 via the fuel conduit 41 inside the valve member 40.

When the value of current to be applied to the coil 52 is zero, that is, when the coil 52 is de-energized, the valve member 40 is urged toward the electromagnetic driving portion 50 by biasing force of the spring 33. The shaft 57 in contact with the valve member 40 and the armature 58 integrated with the shaft 57 are urged in a direction opposite to the valve member 40. The axial movement of the armature 58 as well as the shaft 57 is restricted by a step portion 53*a* coming in contact with the washer 581 and stopped at a position where the step portion 53*a* and the washer 581 contact each other. At this time, the valve member 40 also stops and the moving amount of the valve member 40 is zero.

When the coil 52 is energized, the armature 58 is attracted toward the stator 54 due to magnetic fluxes generated by the coil 52 so that the shaft 57 moves together with the armature 58 toward the valve member 40. The movement of the shaft 57 causes the valve member 40 to move in a direction of compressing the spring 33. That is, the valve member 40 moves downward in FIG. 1. The moving amount of the armature 58 or the shaft 57 is proportional to the value of current to be applied to the coil 52.

The downward movement of the valve member 40 brings the ports 42 of the valve member 40 overlap with the openings 31 of the valve body 30. Accordingly, the ports 42 communicate with the openings 31 so that fuel in the fuel conduit 41 flows to the fuel supply conduit 61 through the ports 42 and the openings 31. Each area of the ports 42 communicating with the openings 31 varies according to the movement of the valve member 40. That is, the area of the port 42 communicating with the opening 40 varies in response to a change of the value of current to be applied to the coil 52.

The change of the area of the port 42 communicating with the opening 31 brings a change of the flow amount of fuel flowing from the fuel conduit 41 to the fuel supply conduit 61 so that the flow amount of fuel to be supplied to the high pressure fuel pump 6 is controlled.

Fuel flown to the fuel supply conduit 61 is supplied to the pressure chamber 63 of the high pressure fuel pump 6 via the return valve 66. Then, the fuel is pressurized by the plunger 62 and, when pressure in the pressure chamber reaches a given value, the return valve 67 opens so that the pressurized fuel is discharged to the fuel delivery conduit 68 and accumulated in the common rail 7 for being injected from each of the injectors 71 to each cylinder of the engine at a given timing.

Next, a relationship between the shape of the opening 31 and the flow amount of fuel to be discharged from the high pressure fuel pump 6 is described.

Since the opening 31 is formed in the shape as shown in FIG. 2, the port 42 communicates at first with the first opening 311, then with the third opening 313 and lastly with the second opening 312 according to the movement of the valve member 40.

In an engine low speed region, that is, when the value of current to be applied to the coil 52 is small so that the moving amount of the valve member 40 is small, the first opening 311 communicates with the port 42. In this region, even if the engine revolution Ne or the accelerator opening degree $\alpha$ varies, the value of current to be applied to the coil 52 varies and the valve member 40 moves axially, a change of the area of the first opening 311 communicating with the port 42 is small.

As the first opening is shaped rectangular, the area of the first opening 311 communicating with the port 42 increases in proportion to the moving amount of the valve member 40. Accordingly, the flow amount of fuel to be supplied to the high pressure fuel pump 6 increases in proportion to the moving amount of the valve member 40, which causes to increase the amount of fuel to be discharged from the high pressure fuel pump 6.

As the value of current to be applied to the coil 52 more increases, the moving amount of the valve member 40 more increases so that the port 42 communicates with the third opening 313 via the first opening 311 and lastly with the second opening 312 via the first and third openings 311 and 313.

Since the shape of the third opening 313 is trapezoid, the area of the third opening 313 communicating with the port 42 increases with a quadratic function according to the movement of the valve member 40. As a result, the flow amount of fuel to be discharged from the high pressure fuel pump 6 increases with the quadratic function.

On the other hand, since the shape of the second opening 312 is rectangular, the area of the second opening 312 communicating with the port 42 increases in proportion to the moving amount of the valve member 40, as that of the first opening 311 does. As a result, the amount of fuel to be discharged from the high pressure fuel pump 6 increases.

Figure 3:
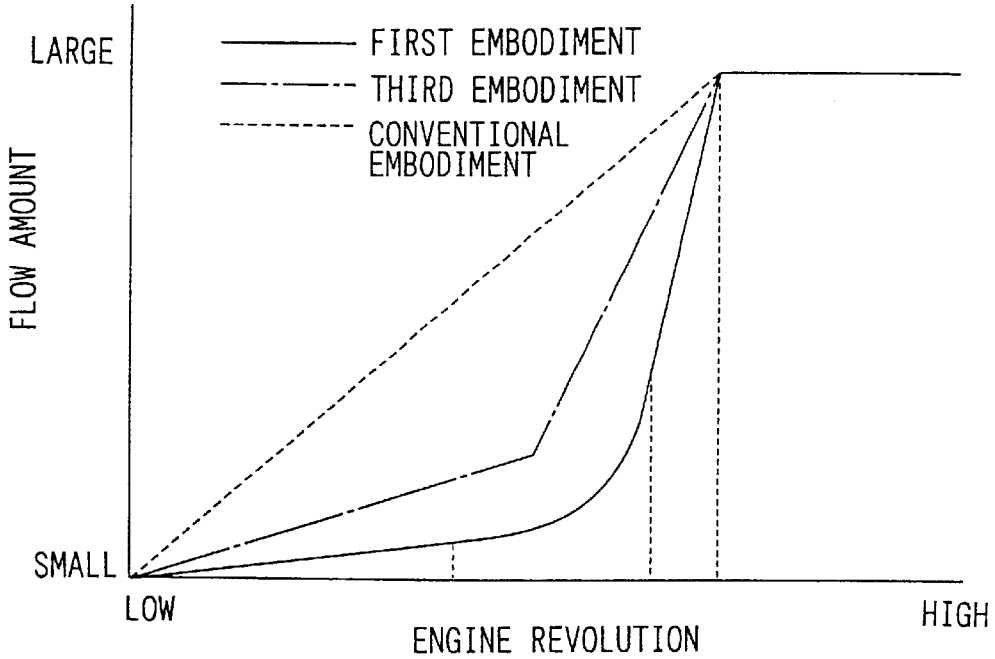
FIG. 3 is a graph showing a relationship between engine revolution and flow amount of fuel to be discharged from a high pressure fuel pump.

As mentioned above, when the valve body 30 is provided with the opening 31 whose shape is shown in FIG. 2, as the value of current to be applied to the coil 52 increases and the moving amount of the valve member 40 increases, change ratios of the discharge amount of fuel are different among three ranges of engine revolution as shown by dotted lines in FIG. 3. Accordingly, the flow amount of fuel to be supplied to the high pressure fuel pump 6 and the flow amount of fuel to be discharged from the high pressure fuel pump 6 vary non-linearly as a whole according to the value of current to be applied to the coil 52.

Since the conventional valve body (conventional embodiment) is provided with the opening that is formed in single rectangular shape or in single oval shape, the area of the opening communicating with the port varies in proportion to the moving amount of the valve member. Accordingly, as shown in FIG. 3, the flow amount of fuel to be discharged from the high pressure fuel pump changes in proportion to the engine revolution. As a result, the change ratio of the area of the opening communicating with the port is constant in an entire region from the engine low speed region to the engine high speed region.

Therefore, a change ratio of the flow amount of fuel to be supplied to the high pressure fuel pump to the moving amount of the valve member is larger especially in the engine low speed region. On the other hand, if the width length of the opening is set to be small to reduce the flow amount of fuel in the engine low speed region, the flow amount of fuel to be supplied to the high pressure fuel pump becomes insufficient in the engine high speed region.

However, according to the present embodiment, as the width length of the first opening 311 is relatively small, the change ratio of the amount of fuel to be supplied to the high pressure fuel pump 6 to the engine revolution is small in the engine low speed region and, as the width length of the second opening 312 is relatively large, the amount of fuel to be supplied to the high pressure fuel pump 6 becomes sufficiently large in the engine high speed region.

As mentioned above, according to the first embodiment, the flow amount of fuel to be discharged from the high pressure fuel pump 6 varies non-linearly according to the engine revolution or the engine load. In particular, as the change ratio of the area of the opening 31 communicating with the port 42 to the moving amount of the valve member 40 is small in the engine low speed region, the change ratio of the flow amount of fuel to be supplied to the high pressure fuel pump 6 as well as the change ratio of the flow amount of fuel to be discharged from the high pressure fuel pump 6 thereto is small. Accordingly, controllability of the flow amount of fuel to be discharged from the high pressure fuel pump 6 is high in the engine low speed region.

Further, as the area of the opening 31 communicating with the port 42 increases in the engine high speed region, the flow amount of fuel to be supplied to the high pressure fuel pump 6 or the flow amount of fuel to be discharged from the high pressure fuel pump 6 sufficiently increases. Accordingly, the flow amount of fuel to be supplied to the high pressure fuel pump 6 is optimally controlled according to engine revolution.

Though the opening 31 is constituted by the first and second openings 311 and 312 that are shaped rectangular and the third opening 313 that is shaped trapezoidal according to the first embodiment, the shape of the opening 31 is not limited to those mentioned above but may be changed to any shape corresponding to characteristics of the engine applied to the common rail fuel injection system. That is, change of the length of the opening in an axial direction of the valve body, change of the width length thereof or change of the shape of the opening makes it possible to provide a flow amount control device operative in responsive to any of various engine characteristics.

Second Embodiment

Figure 4:
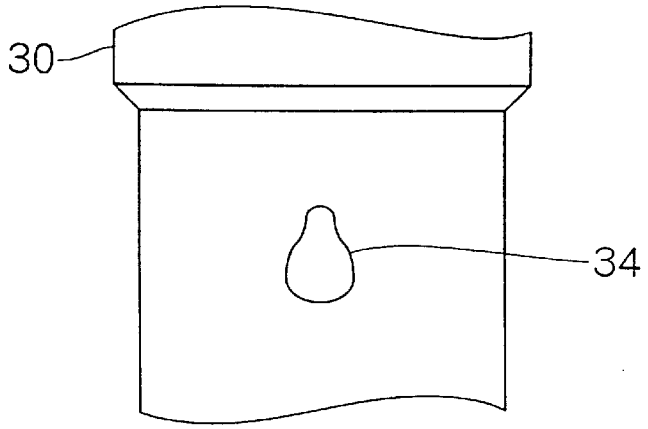
FIG. 4 is a schematic side view of a portion near an opening of a valve body of a flow amount control device according to a second embodiment as viewed from a same direction as shown by an arrow I of FIG. 1.

A flow amount control device according to a second embodiment is described with reference to FIG. 4. Component parts substantially similar to the first embodiment have the same reference numbers and the explanations thereof are omitted.

According to the second embodiment, each shape of openings 34 formed in the valve body 30 differs from that of the first embodiment. Each of the openings 34 of the second embodiment, as shown in FIG. 4, is constituted by a first opening 341, a second opening 342 and a third opening 343, each corner of which is rounded. As the corners of the opening 34 are rounded, the flow amount of fuel to be discharged from the high pressure pump 6 may be smoothly changed according to change of engine revolution.

Third Embodiment

Figure 5A:
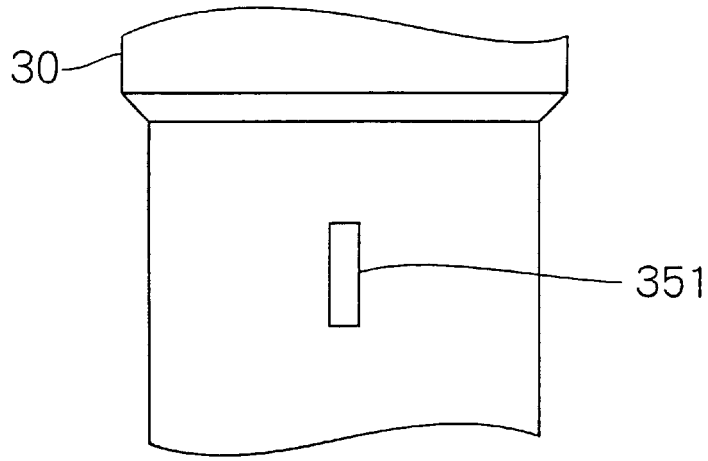
FIG. 5A is a schematic side view of a portion near an opening of a valve body of a flow amount control device according to a third embodiment as viewed from a same direction as shown by an arrow I of FIG. 1.
Figure 5B:
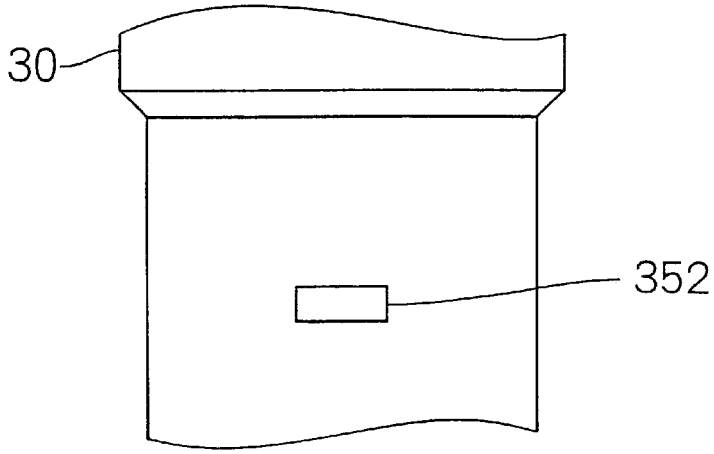
FIG. 5B is a schematic side view of a portion near the opening of the valve body of the flow amount control device according to the third embodiment as viewed from a same direction as shown by an arrow V of FIG. 1.
Figure 5C:
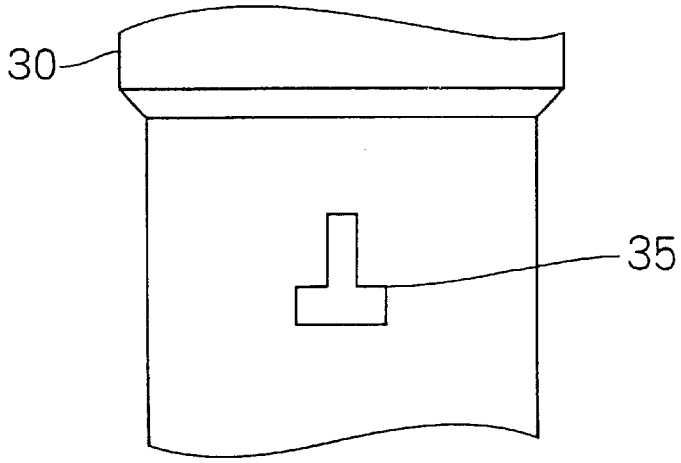
FIG. 5C is a schematic side view of a portion near an opening of a valve body of a flow amount control device which is equivalent to a shape formed by combining the openings of FIGS. 5A and 5B.

A flow amount control device according to a third embodiment is described with reference to FIGS. 5A to 5C.

Component parts substantially similar to the first embodiment have the same reference numbers and the explanations thereof are omitted.

According to the third embodiment, each shape of openings 35 formed in the valve body 30 differs from that of the first embodiment. The valve body 30 is provided with vertical openings 351 each of which is shaped in rectangle whose longer side extends in an axial direction thereof, as shown in FIG. 5A, and lateral openings 352 each of which is shaped in rectangle whose longer side extends in a circumferential direction thereof, as shown in FIG. 5B. Each of the vertical openings 351 and each of the lateral openings 352 constitute a pair in the valve body 30. When the moving amount of the valve member 40 is small, the respective vertical openings 351 communicate with the ports 42 and, when the moving amount of the valve member 40 is large, both of the respective vertical and lateral openings 351 and 352 communicate with the ports 42. As a result, each of the openings 35, each equivalent to a shape formed by combining any pair of the vertical and lateral openings 351 and 352 as shown in FIG. 5C, communicates with each of the ports 35.

According to the third embodiment, the area of the opening 35 communicating with the port 42 changes proportionally in response to the moving amount of the valve member 40 but in a gentle changing slope in the engine low speed region and in a steep changing slop in the engine high speed region, as shown in FIG. 3. Therefore, as a whole, the area of the opening 35 communicating with the port 42 changes non-linearly in response to the moving amount of the valve member 40. As each shape of the vertical and lateral openings 351 and 352 is simply rectangular, formation of the opening 35 is so easy that the flow amount control device may be manufactured at less cost.

The valve member moves to make the opening communicate with the port when current is applied to the electromagnetic driving portion in the flow amount control device according to the embodiments mentioned above, the valve member may move to interrupt the communication between the opening and the port when current is applied to the electromagnetic driving portion. In this case, the shape of the opening is formed upside down compared with the opening described in the embodiments mentioned above.

What is claimed is:

1. A flow amount control device for controlling flow amount of fuel to be supplied via a supply conduit to a high pressure fuel pump that discharges pressurized fuel to an accumulation chamber, comprising:

a valve body having at least an opening for communicating with the supply conduit, the opening being constituted by a first opening, a second opening whose circumferential length in the valve body is larger than that of the first opening, and a third opening bridging between the first and second openings in such a manner that the first, third and second openings are continuously formed in an axial direction of the valve body;

a valve member housed slidably inside the valve body, the valve member being provided inside with a fuel conduit through which fuel flows and in circumference with at least an outlet port connected to the fuel conduit; and driving means for causing an axial movement of the valve member in the valve body when current is applied thereto, wherein the opening is formed in such shape that an area of the opening communicating with the outlet port, through which fuel flows from the fuel conduit to the supply conduit, varies non-linearly in response to a moving amount of the valve member.

2. A flow amount control device according to claim 1, wherein a change ratio of the area of the opening communicating with the outlet port to the moving amount of the valve member is smaller, when largeness of the area of the opening communicating with the outlet port is below a predetermined value, than that when the largeness of the area of the opening communicating with the outlet port is over the predetermined value.

3. A flow amount control device according to claim 2, wherein the moving amount of the valve member changes in proportion to a value of the current to be applied to the driving means.

4. A flow amount control device according to claim 1, wherein a change ratio of the area of the opening communicating with the outlet port to a value of current applied to the driving means is smaller, when largeness of the area of the opening communicating with the outlet port is below a predetermined value, than that when the largeness of the area of the opening communicating with the outlet port is over the predetermined value.

5. A flow amount control device according to claim 1, wherein each shape of the first and second openings is roughly rectangular and shape of the third opening is trapezoidal.

6. A flow amount control device according to claim 5, wherein each corner of the first,second and third openings is rounded.

7. A flow amount control device according to claim 1, wherein the valve body has a plurality of openings that are formed at circumferentially spaced intervals.

8. A flow amount control device for controlling flow amount of fuel to be supplied via a supply conduit to a high pressure fuel pump that discharges pressurized fuel to an accumulation chamber, comprising:

a valve body having a plurality of openings for communicating with the supply conduit, the plurality of openings being constituted by at least one set of openings which are formed at positions different axially from each other in the valve body and whose shapes are different from each other;

a valve member housed slidably inside the valve body, the valve member being provided inside with a fuel conduit through which fuel flows and in circumference with at least an outlet port connected to the fuel conduit; and driving means for causing an axial movement of the valve member in the valve body when current is applied thereto, wherein a total area of the openings communicating with the outlet port, through which fuel flow from the fuel conduit to the supply conduit, varies non-linearly in response to a moving amount of the valve member.

9. A flow amount control device according to claim 8, wherein a change ratio of the total area of the openings communicating with the outlet port to the moving amount of the valve member is smaller, when largeness of the total area of the openings communicating with the outlet port is below a predetermined value, than that when the largeness of the total area of the openings communicating with the outlet port is over the predetermined value.

10. A flow amount control device according to claim 9, wherein the moving amount of the valve member changes in proportion to a value of the current to be applied to the driving means.

11. A flow amount control device according to claim 8, wherein a change ratio of the total area of the openings communicating with the outlet port to a value of current applied to the driving means is smaller, when largeness of the total area of the openings communicating with the outlet port is below a predetermined value, than that when the largeness of the total area of the openings communicating with the outlet port is over the predetermined value.

12. A flow amount control device according to claim 8, wherein each shape of the set of openings is rectangular and circumferential length of one of the set of openings is larger than that of another of the set of openings.

* * * * *